United States Patent [19]

Durfee, Jr.

[11] Patent Number: 4,545,122

[45] Date of Patent: Oct. 8, 1985

[54] CHAIN SAW GAUGING ATTACHMENT

[75] Inventor: David L. Durfee, Jr., Marshall Road, Meadville, Pa. 16335

[73] Assignee: David L. Durfee, Jr., Meadville, Pa.

[21] Appl. No.: 530,945

[22] Filed: Sep. 12, 1983

[51] Int. Cl.[4] ..... B27B 17/02

[52] U.S. Cl. ..... 30/383; 33/185 R; 83/468

[58] Field of Search ..... 30/381, 382, 383, 373; 403/328, 385; 33/185 R; 83/468

[56] References Cited

U.S. PATENT DOCUMENTS

| | | | |
|---|---|---|---|
| 2,554,928 | 5/1951 | Segal | 83/468 |
| 2,800,933 | 7/1957 | Michael | 30/373 |
| 2,807,292 | 9/1957 | Gelinas | 30/383 |
| 3,276,490 | 10/1966 | Johansson | 30/383 X |
| 3,364,580 | 1/1968 | Lucia | 30/383 X |
| 3,531,870 | 10/1970 | Romancky | 30/383 X |
| 4,185,382 | 1/1980 | Rawlinson | 30/383 |
| 4,233,739 | 11/1980 | Hinrichs | 30/383 |
| 4,341,018 | 7/1982 | Nelson | 30/383 |
| 4,377,910 | 3/1983 | Landry | 30/383 |
| 4,388,762 | 6/1983 | Debell | 33/185 R |

*Primary Examiner*—Jimmy C. Peters

*Attorney, Agent, or Firm*—Wayne L. Lovercheck; Charles L. Lovercheck; Dale R. Lovercheck

[57] ABSTRACT

A chain saw gauging attachment having a fitting at one end adapted to be received under an existing nut on an existing stud of a chain saw, a rod extending outwardly from the fitting, means for firmly attaching the rod to the fitting, and an indicator which is slidably affixed to the rod and adapted to be fixed in predetermined positions. The fitting of the gauging attachment may be provided with a rotating means which permits the gauging attachment to be swung to the rear of the chain saw and away from the working area when not in use. When mounted, the gauge rod extends along the length of the work piece of a log to which is to be cut, and the indicator of the gauge rod enables the user to fix by sight the place on the log where the next cut is to be made. The gauge rod is slender and resilient whereby it will spring back to its original shape if accidently flexed.

6 Claims, 7 Drawing Figures

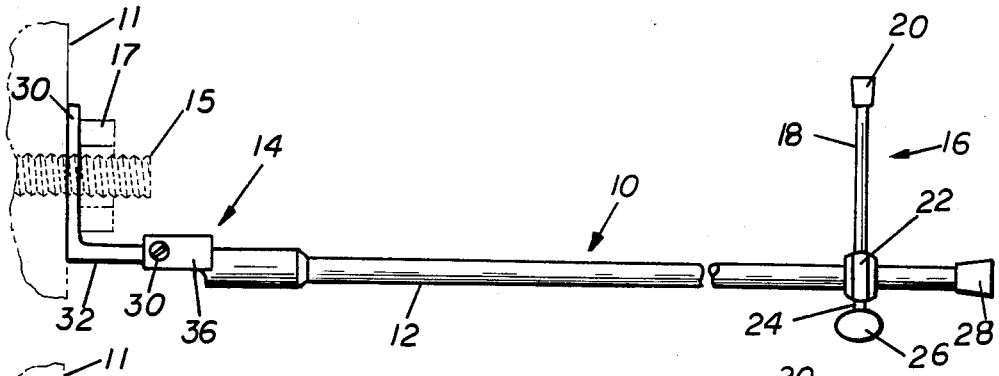
FIG. 3.
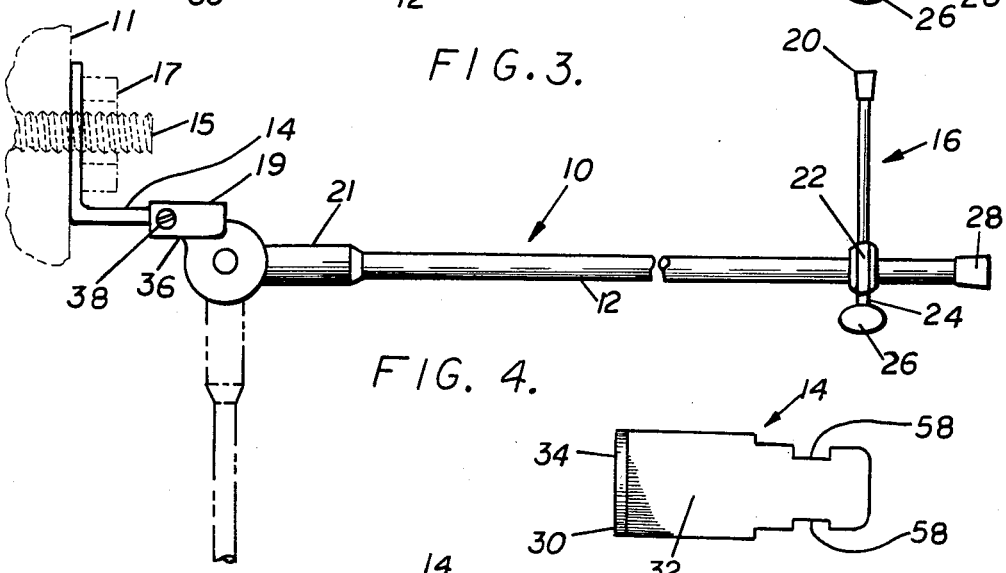
FIG. 4.
FIG. 7.
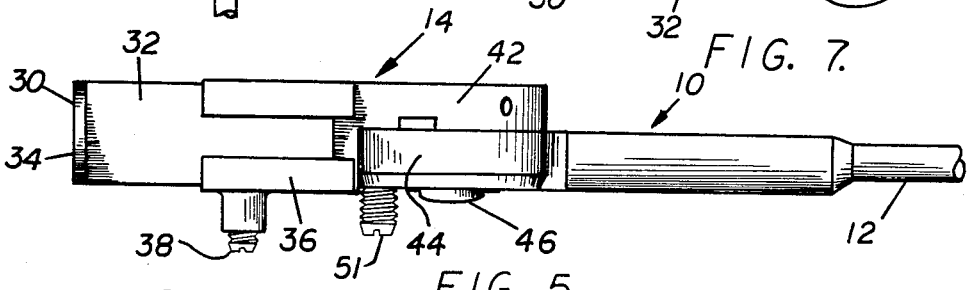
FIG. 5.
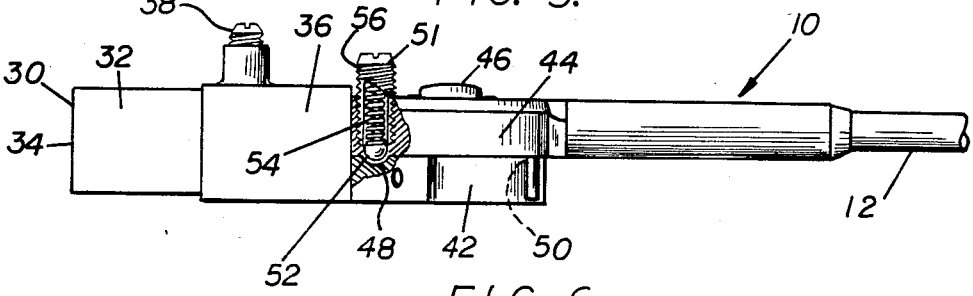
FIG. 6.

CHAIN SAW GAUGING ATTACHMENT

BACKGROUND OF THE INVENTION

This invention relates to a gauging attachment for a conventional portable type chain saw and more particularly to attachments of this type which are intended to faciliate the cutting of logs, branches, etc., into uniform lengths. With this attachment successive cuts of identical lengths can be made rapidly in either direction, that is cutting with the indicator at the end of the log, or sighting to the indicator and moving the saw to the indicated work position. Any desired length can be determined by moving the indicator to an appropriate position along the rod and securing the indicator in position.

It is generally known to attach a measuring device to a chainsaw in order to facilitate cutting successively equal lengths of wood. Various guaging attachments for chain saws have been proposed to enable the user to guage and cut logs into desired uniform lengths. For example U.S. Pat. No. 4,185,382 having a chain saw gauging attachment having a rod intended to be bent into position to indicate a length and the protruding portion of an existing stud.

To obtain the desired length of cut it is discussed in Hinrichs U.S. Pat. No. 4,233,739 and Romancky U.S. Pat. No. 3,531,870 which utilize telescoping lengths of cylindrical tubes in which frictional engagement which can be moved to any desired length for successfully measuring off equal cuts of a log to be cut by the chain saw. Other efforts to provide measuring attachments for chain saws include the Gelinas U.S. Pat. No. 2,807,292 which discloses a folding ruler type gauging device attached to the chain saw. The Lucia U.S. Pat. No. 3,364,580 and Johansson U.S. Pat. No. 3,276,490 Patents show retractable ruler tape type measuring device having hooks at their end and adapted to be attached to the frame of the chain saw and the flexible tape intended to be pulled out and hooked onto the end of a log or limb enabling the user to position the saw for the next cut. These devices have the drawback that the tape must be reset or hooked each time that a new cut is to be made thus slowing the rate of working.

A drawback to all of these prior proposals for gauging attachments for chain saws is that special hardware is required to adapt the chain saw to accept the gauging attachment or numerous additions of the chain saw attachment must be made to accommodate all makes and models of chain saws. For example, the Rawlinson Patent which shows a fitting adapted to screw onto the protruding portion of an existing stud of the chain saw frame must be provided with various internal threads to accommodate the variety of threads used in chain saws. Thus, there is a need in the art for providing a chain saw gauging attachment which may be readily attached to any existing chain saw irregardless of the peculiarities of the particular chain saw to which it is desired to add the attachment. It, therefore, is an object of this invention to provide an improved chain saw gauging attachment having an attaching system for attaching the attachment to any existing portable chain saw.

SHORT STATEMENT OF THE INVENTION

Accordingly, the chain saw gauging attachment of the present invention includes an attaching means being adapted to be readily affixed to an existing stud of a chain saw irregardless of the size or shape of the threads of the stud. A coupling means is adapted to attach to and disconnect from the attaching means.

A spring plunger may be employed to secure the coupling means to the attaching means. The spring plunger will permit the attachment and removal of the gauging attachment by hand operation of the operator.

A rod holder is attached to the coupling means and is adapted to receive and hold a rod therein. The rod is adapted to extend perpendicular to a cutting plane of the chain saw and has an indicator slidably attached thereto.

The indicator has a pointer extending outwardly from the rod and adapted to be flexible so that to prevent snagging on branches and brush while the device is in use. The pointer may be made of a wire spiral or very resilient plastic or other suitable material. The indicator may be provided with a wing screw to hold the indicator at a predetermined position along the rod.

In an alternative embodiment a hinge may be provided between the coupling means and the rod holder to permit the chain saw gauging attachment to be swung rearwardly when it is not to be used temporarily which will permit the quickly swinging back into a working position when the gauging attachment is to be used.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 3 is a top view of a preferred embodiment of the chain saw gauging attachment of the present invention;

FIG. 4 is a top plane view of a second preferred embodiment of the chain saw gauging attachment of the present invention with the second position of the rotating gauging attachment being shown in broken outline;

FIG. 5 is a partial side plane view of a first side of a second preferred embodiment of the chain saw gauging attachment of the present invention;

FIG. 6 is a partial side plane view of a second side of a second preferred embodiment of the chain saw gauging attachment of the present invention with the hinge of the apparatus being partially broken away to reveal the position locking mechanism of the apparatus;

FIG. 7 is a side view of the attaching member illustrating the notch that is engaged by the spring plunger to secure the gauging attachment to the chain saw.

DETAILED DESCRIPTION OF THE PREFERRED EMBODIMENT

Figure 1:
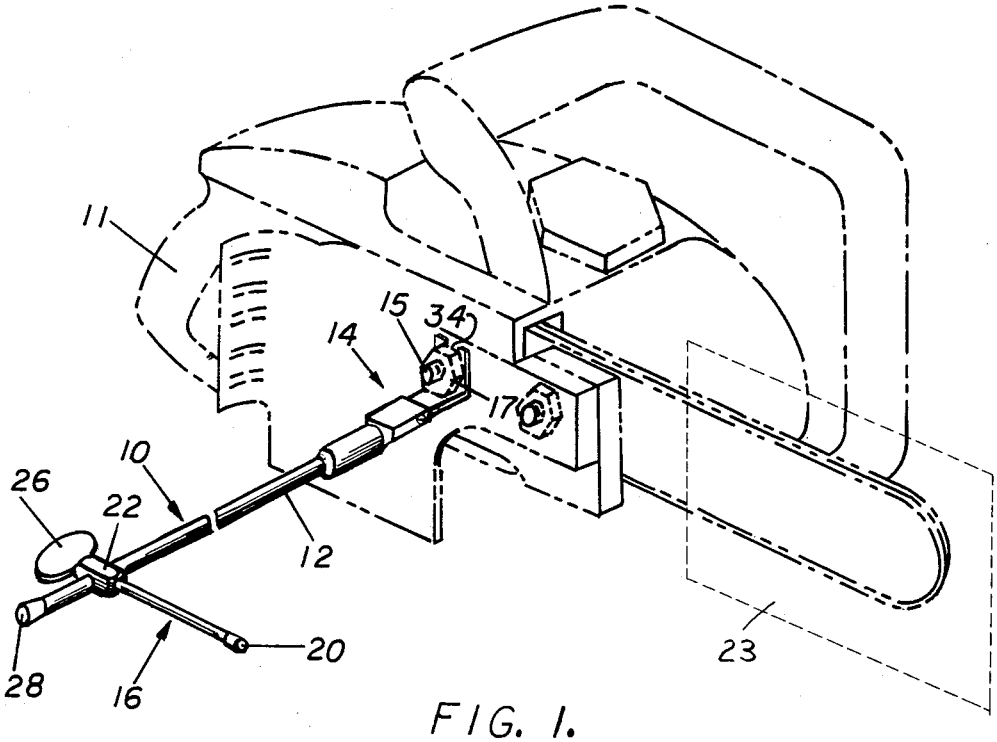
FIG. 1 is a perspective view of a preferred embodiment of the chain saw gauging attachment of the present invention with a chain saw shown in phantom to show the gauging device in working position.
Figure 2:
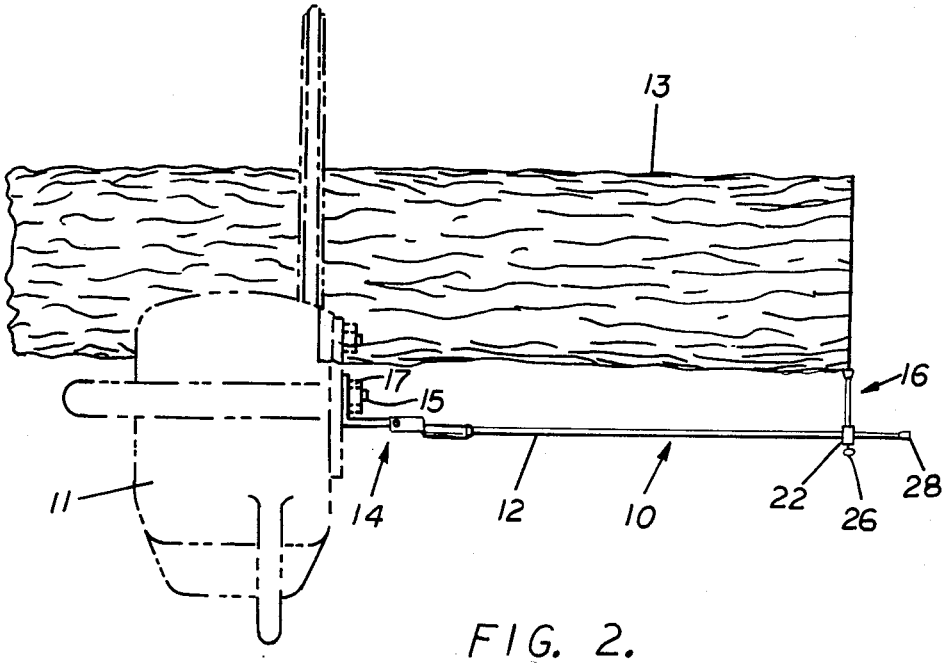
FIG. 2 is a top plane view of a preferred embodiment of the chain saw gauging attachment of the present invention with the chain saw shown in phanton, the gauging attachment being shown extending along a log which is to be cut.

The preferred embodiment of the present invention is illustrated by way of example in FIGS. 1–7. With specific reference to FIGS. 1, 2, 3, and 7, the chain gauging attachment 10 is adapted to be affixed to a chain saw 11 which may be any standard, conventional model portable chain saw. The chain gauging attachment being provided with a rod 12 which is adapted to extend outwardly from a chain saw and to extend along a log 13 and generally perpendicular to a cutting plane 23 of the chain saw when the chain saw is in a working position. An attaching means may comprise an attaching member 14 which is adapted to be placed over an existing stud 15 and secured in place by an existing nut 17 on the conventional portable chain saw.

An indicating means 16 is adapted to be moved along the length of the rod 12. The indicating means may have a pointer 18 made of a resilient material to prevent snagging in brush and branches when in use and adapted to point forwardly relative to the chain saw and parallel to a cutting plane 23 thereof. The pointer 18 may be made of a metallic coil and may be provided with a tip 20. A set screw 24 is provided with a hand engaging wing 26 for tightening and loosening a screw in the slider 22 to rigidly fix the indicating means 16 in a predetermined position. The end of the rod 12 may be provided with a tip 28 to prevent injury from the end of the rod.

The attaching means may comprise an attaching member 14 having a first end or member 30 and a second end or member 32. The first member may be disposed at approximately right angles to the second member and have an aperture 34 disposed therein adapted to receive the existing stud 15 on the chain saw frame. The first end and second end are rigidly attached to each other. The second end 32 is adapted to be received by the coupling means 19 and is provided with notches 58 to receive a ball similar to ball 52 urged by spring plunger 38. As shown in FIG. 7, a notch 58 is provided along each edge of the second member 32 so that the gauging attachment may be attached regardless of the orientation of the attaching member. The coupling means may comprise a bracket 36 having a spring plunger similar to plunger 38 adapted to engage the second member thus affixing the chain saw gauging attachment to a portable chain saw. The spring plunger 38 has a steel ball 52 which is urged downwardly by a spring 54. The tension of the spring is adjustable by means of the threaded screw 56. The bracket is rigidly affixed at its second end to the rod receiving member 21. The spring plunger 38 permits the quick removal by hand of the chain saw gauging attachment when it is desired to have the attachment out of the way and off the chain saw for a period of time during operation.

In a preferred embodiment which is illustrated by way of examples in FIGS. 4–6, a hinge is provided between the bracket 36 and the rod receiving member 21. The hinge is adapted to permit the chain saw gauging attachment to be moved by hand rearwardly temporarily out of the way when not being used for short periods of time during operation of the chain saw. The hinge may consist of a first hinge half 42 rigidly affixed to the bracket and a second hinge half 44 rigidly affixed to the rod receiving member.

FIG. 4 illustrates the chain saw gauging attachment in an extended position in full lines and in a retracted position in phantom lines. The hinge pin 46 completes the hinge and permits the rotation of the first hinge half and second hinge half relative to each other within the limits provided by first stop 48 and second stop 50. A spring plunger 51 may be provided consisting of a steel ball 52 which is urged downwardly by spring 54. The tension of the spring is adjustable by means of the threaded screw 56. When the depression which forms the first stop 48 passes under the ball 52, the spring 54 urges the ball into the stop and the chain saw gauging attachment is semi-rigidly restrained in a first position which may be referred to as the extended position. When the depression of the second stop 50 moves beneath the ball 52, the spring 54 urges the ball into the second stop and the chain saw guaging attachment is restrained in a second position which may be referred to as the retracted position.

The spring plunger 51 permits the quick movement away from the operating area by hand of the chain saw gauging attachment when it is desirable to have the attachment out of the way for brief periods during operation. This permits the intermittent use of the gauging attachment as when trimming branches and cutting up the larger material into uniform lengths without having to detach and reattach the device.

The present invention provides an improved chain saw gauging attachment which can be easily manipulated for the purposes of cutting branches and trees into uniform length pieces. The gauging attachment has a quick, simple, and reliable means for detaching the attachment from a chain saw or temporarily moving the attachment away from the work position. Thus the gauging attachment of the present invention has the important advantage of providing a means for intermittently using the gauging attachment without interrupting the work at hand.

While the present invention has been disclosed in connection with the preferred embodiment thereof, it should be understood that there may be other embodiments which may fall within the spirit and scope of the invention as defined by the following claims.

The embodiments of the invention in which an exclusive property or privilege is claimed are defined as follows:

1. An axial cut gauging attachment for chain saws comprising a rod, indicating means, an L-shaped bracket having a first end and a second end, an attaching means to attach said rod to said bracket, said first end of said L-shaped bracket having an aperature therein adapted to receive an existing stud on a chain saw, said second end of said L-shaped bracket having at least one notch therein, said attaching means having coupling means having a recess therein adapted to receive said second end of said L-shaped bracket, detent means on said attaching means adapted to be received in said notch for holding said rod to said bracket, said attaching means attached to or removed from said bracket by a bracket push or pull, said attaching means having a first part attached to said rod and a second part attached to said bracket, pivot means connecting said first part and said second part of said attaching means together whereby said rod can be swung from a position perpendicular to the cutting plane of said chain saw and to a position parallel to said cutting plane, spring loaded means on said first part engaging detent means on said second part for holding said rod selectively in said first position and said second position.

2. The gauging attachment recited in claim 1 wherein means is provided for slideably supporting said indicating means on said rod.

3. The length of cut gauging attachment for chain saws as recited in claim 1 wherein the indicating means comprises:

a pointer adapted to extend outwardly from the rod and generally parallel to a chain saw cutting plane, a wing screw adapted to fix the position of the movable pointer along the length of the rod.

4. The length of cut gauging attachment for chain saws as recited in claim 1 wherein the pointer is a resilient member whereby the pointer will bend when engaging a branch or other obstacle thereby preventing snagging.

5. The length of cut gauging attachment for chain saws as recited in claim 1 wherein a hinge is provided between the coupling means and the rod receiving member.

6. The length of cut gauging attachment for chain saws as recited in claim 1 wherein the pointer is a resilient member whereby the pointer will bend when engaging a branch or other obstacle thereby preventing snagging.

* * * * *